US005836562A

United States Patent [19]

Danzyger et al.

[11] Patent Number: 5,836,562

[45] Date of Patent: Nov. 17, 1998

[54] MOUNTING DEVICE FOR AN APPARATUS FOR SUPPORTING A KEYBOARD

[75] Inventors: Howard L. Danzyger, Aurora; James F. Caruso, Evanston; David C. Brown, Chicago; Michael C. Thuma, Des Plaines; Michael J. Anguiano, Addison, all of Ill.

[73] Assignee: Fellowes Manufacturing Company, Itasca, Ill.

[21] Appl. No.: 840,396

[22] Filed: Apr. 29, 1997

Related U.S. Application Data

[63] Continuation-in-part of Ser. No. 699,900, Aug. 16, 1996.

[51] Int. Cl.[6] ..... A47F 1/10

[52] U.S. Cl. ..... 248/295.11; 248/231.71; 248/918; 108/97; 108/98; 312/334.7

[58] Field of Search ..... 248/295.11, 229.25, 248/226.11, 231.71, 918; 108/97, 98; 312/334.4, 334.7, 208.1

[56] References Cited

U.S. PATENT DOCUMENTS

| | | | |
|---|---|---|---|
| 1,867,276 | 7/1932 | McIntyre | 248/231.71 |
| 1,878,850 | 9/1932 | Hilgers | 248/231.71 |
| 2,628,051 | 2/1953 | Anderson | 248/231.71 |
| 2,998,476 | 8/1961 | Nix | 248/231.71 |
| 4,736,689 | 4/1988 | Stanko . | |
| 4,901,972 | 2/1990 | Judd et al. . | |
| 5,037,163 | 8/1991 | Hatcher . | |
| 5,062,609 | 11/1991 | Hames et al. . | |
| 5,213,401 | 5/1993 | Hatcher . | |
| 5,288,042 | 2/1994 | Grimm | 248/918 |
| 5,351,897 | 10/1994 | Martin | 248/918 |
| 5,402,972 | 4/1995 | Schmidt | 248/918 |
| 5,405,204 | 4/1995 | Ambrose . | |
| 5,483,902 | 1/1996 | Grosch . | |
| 5,533,820 | 7/1996 | Ambrose . | |
| 5,590,607 | 1/1997 | Howard | 248/231.7 |

*Primary Examiner*—José V. Chen
*Assistant Examiner*—Anthony D. Barfield
*Attorney, Agent, or Firm*—Sean M. Sullivan; Brinks Hofer Gilson & Lione

[57] ABSTRACT

A mounting device for removably attaching a support apparatus to a work surface, the support apparatus having a first mounting bracket with a first attachment plate and a second mounting bracket with a second attachment plate. The mounting device comprises a first clamp slidably connected to the first mounting bracket and a second clamp slidably connected to the second mounting bracket. Each clamp has a first wall, a second wall, and a third wall. The first attachment plate is positioned between the first and third walls of the first clamp, and the second attachment plate is positioned between the first and third walls of the second clamp.

20 Claims, 9 Drawing Sheets

MOUNTING DEVICE FOR AN APPARATUS FOR SUPPORTING A KEYBOARD

This application is a continuation-in-part of U.S. Ser. No. 08/699,900, filed Aug. 16, 1996, and specifically incorporated herein by reference in its entirety.

BACKGROUND OF THE INVENTION

The present invention relates to a mounting device for an apparatus that supports a keyboard. In particular, the present invention relates to a pair of clamps for removably attaching the keyboard supporting apparatus to a work surface.

In order to conserve space, computer keyboards are often placed in computer keyboard trays that are either fixedly, rotationally, or slidably mounted to a desk or table through a support. Generally, the supports for these trays are fixedly attached to the underside of a work surface such as a desk or table. The keyboard tray slides out and away from underneath the desk or table for use by an operator. The keyboard tray can then be slid back toward and under the table or desk for storage purposes and conservation of space when the operator is no longer using the keyboard. The computer keyboard trays known in the prior art, however, generally tend to be expensive and/or limited in the variety of positions and the degree of adjustments that are available for the tray once it is slid out from underneath the desk or table. Moreover, the trays known in the prior art are often complex. In addition, the removability of these prior art trays and their supports is limited since they are usually fixedly attached (i.e. screwed) to the underside of a work surface. This poses a problem for people with expensive or metal work surfaces.

Accordingly, it is an object of the present invention to provide an apparatus for supporting a computer keyboard that is an improvement over the prior art computer keyboard trays and overcomes the previously mentioned disadvantages associated with such prior art computer keyboard trays. The apparatus of the present invention utilizes a plurality of adjustable mounting brackets that are simple in design, easy to use, compact in size, and relatively inexpensive. Most importantly, the apparatus of the present invention provides a diverse range of positions available for the keyboard tray, including various vertical and/or angular positions.

It is also an object of the present invention to provide a simple and non-destructive mounting device for removably attaching the apparatus for supporting a computer keyboard to a work surface. The simple mounting device utilizes a pair of C-shaped clamps to attach the keyboard support apparatus to a work surface, and then allow easy removal of the keyboard support apparatus from the work surface.

SUMMARY OF THE INVENTION

The present invention provides a mounting device for removably attaching a support apparatus to a work surface, the support apparatus having a first mounting bracket with a first attachment plate and a second mounting bracket with a second attachment plate. The mounting device of the present invention comprises a first clamp slidably connected to the first mounting bracket and a second clamp slidably connected to the second mounting bracket. Each clamp has a first wall, a second wall, and a third wall, with the first attachment plate being positioned between the first and third walls of the first clamp, and the second attachment plate being positioned between the first and third walls of the second clamp.

DETAILED DESCRIPTION OF THE PREFERRED EMBODIMENTS

Figure 1:
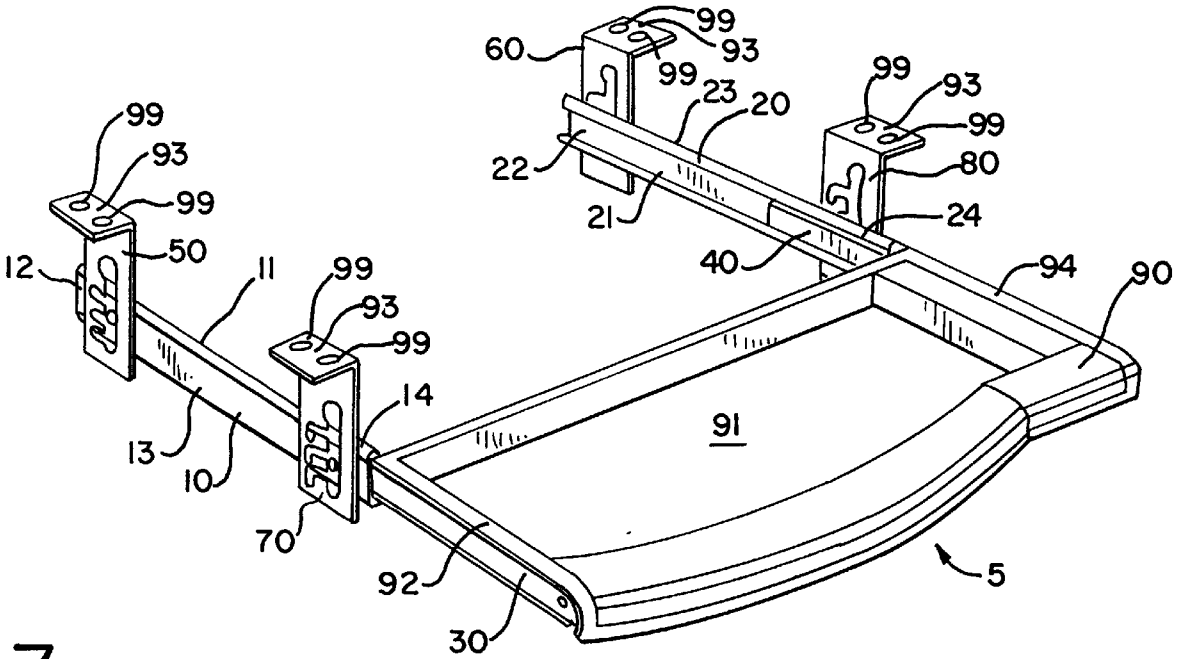
FIG. 1 is a perspective view of a preferred embodiment of the apparatus for supporting a keyboard of the present invention.

Turning now to the drawings, FIGS. 1–4 depict the preferred embodiment of the apparatus of the present invention for supporting a keyboard. As shown in FIG. 1, the apparatus 5 of the preferred embodiment comprises a first and a second mounting member 10, 20, a first and a second tray member 30, 40, a keyboard tray 90, a first and a second rear mounting bracket 50, 60, and a first and a second front mounting bracket 70, 80.

The first and the second mounting members 10, 20 each have a first end 12, 22 and a second end 14, 24 spaced from the first end. The first and the second mounting members 10, 20 also each have an inner side 11, 21 and an outer side 13, 23 opposite the inner side.

Figure 3:
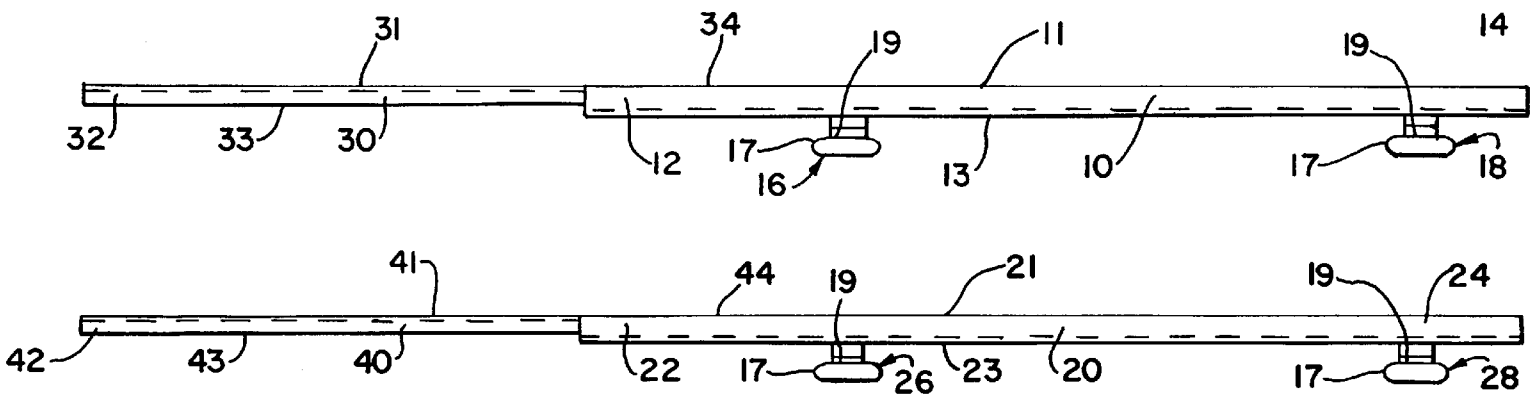
FIG. 3 is top view of the mounting members and tray members of FIG. 2 in an open position.
Figure 2A:
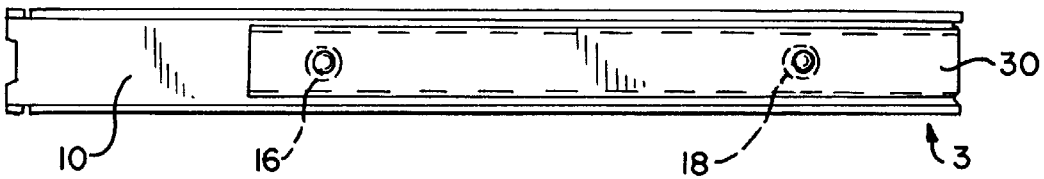
FIGS. 2*a* and 2*c* show a side view of the mounting members and tray members of the apparatus of FIG. 1, in a closed position.
Figure 2B:
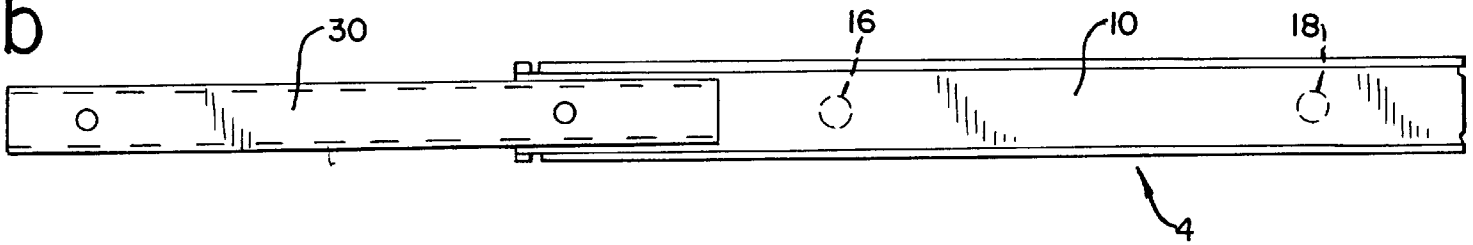
FIGS. 2*b* and 2*d* show a side view of the mounting members and tray members of the apparatus of FIG. 1, in an open position.
Figure 2C:
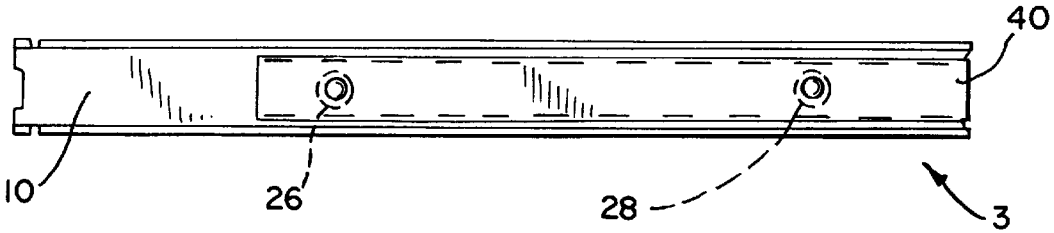
Figure 2D:
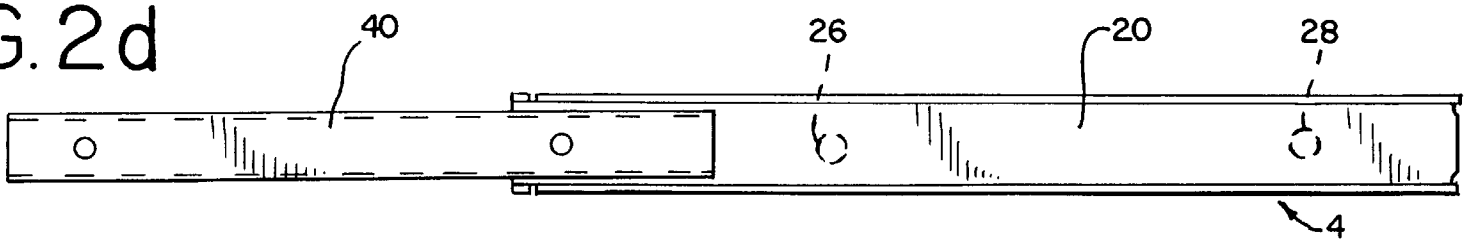

As shown in FIGS. 2–3, a first retention post 16 is disposed on the outer side 13 of the first mounting member 10 near its first end 12, and a second retention post 18 is disposed on the outer side 13 of the first mounting member 10 near its second end 14. In addition, a third retention post 26 is disposed on the outer side 23 of the second mounting member 20 near its first end 22, and a fourth retention post 28 is disposed on the outer side 23 of the second mounting member 20 near its second end 24. In the most preferred embodiment of the present invention, a retaining member such as a head 17 is disposed on each retention post at an end 19 of the retention post opposite the mounting member, i.e. at the distal end of the post. Preferably, the heads 17 have an outer diameter 15 that is greater than the diameter of the retention posts and the width of slots in the mounting bracket. As a result, the retention posts are free to move in the slots of the mounting bracket while the heads keep the retention posts from slipping out of the slots. As an alternative retaining member to the heads 17, end caps may be connected to the end 19 of each retention post opposite the mounting members. Similar to the heads, the end caps would have an outer diameter that is greater than the diameter of the retention posts and the width of slots in the mounting bracket, and thus would allow the retention posts to move freely in the slots of the mounting bracket while keeping the retention posts from slipping out of the slots.

As also shown in FIGS. 2–3, the first and the second tray members 30, 40 each have a first end 32, 42 and a second end 34, 44 spaced from the first end. The first and the second tray members 30, 40 also each have an inner side 31, 41 and an outer side 33, 43 opposite the inner side. The first tray member 30 is slidably mounted to the first mounting member 10 with the outer side 33 of the first tray member facing the inner side 11 of the first mounting member. Similarly, the second tray member 40 is slidably mounted to the second mounting member 20 with the outer side 43 of the second tray member facing the inner side 21 of the second mounting member. Preferably, the first and second tray members have a locking device (not shown) for temporarily precluding the sliding of the first and second tray members along the first and second mounting members, respectively, when the keyboard tray 90 is in a fully open position.

As shown in FIG. 1, the keyboard tray 90 has a first side 92 and a second side 94 spaced from the first side. The first side 92 of the keyboard is connected to the inner side 31 of the first tray member 30, and the second side 94 of the keyboard is connected to the inner side 41 of the second tray member 40. The keyboard tray 90 may also have a well 91 that is adapted to receive and support a computer keyboard.

The first and second rear mounting brackets 50, 60 are adjustably mounted to the first end 12 of the first mounting member 10 and the first end 22 of the second mounting member 20, respectively. The first and second front mounting brackets 70, 80 are adjustably mounted to the second end 14 of first mounting member 10 and the second end 24 of the second mounting member 20, respectively. In particular, the first rear mounting bracket 50 is adjustably mounted to the first retention post 16, the second rear mounting bracket 60 is adjustably mounted to the third retention post 26, the first front mounting bracket 70 is adjustably mounted to the second retention post 18 and the second front mounting bracket 80 is adjustably mounted to the fourth retention post 28.

Figure 13:
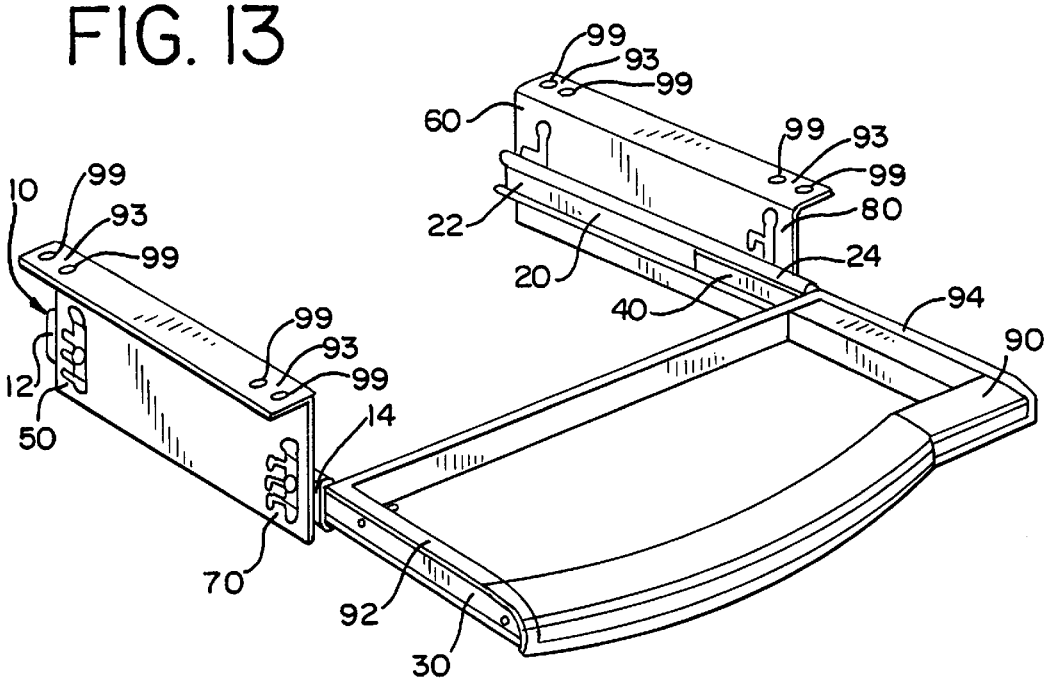
FIG. 13 is a perspective view of another embodiment of the apparatus of the present invention.
Figure 14:
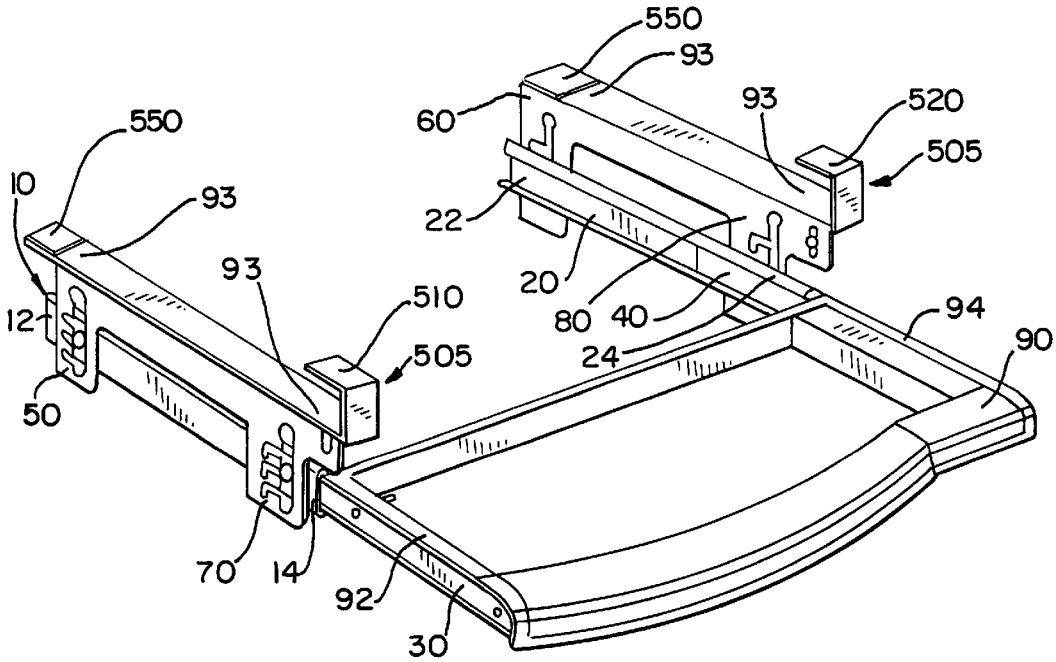
FIG. 14 is a perspective view of an apparatus for supporting a keyboard with the simple mounting device of the present invention.

In the preferred embodiment of the present invention, the first and second rear mounting brackets 50, 60 and the first and second front mounting brackets 70, 80 are all separate components. It is contemplated, however, that the first rear mounting bracket 50 and the first front mounting bracket 70 may be coextensive or integral, as shown in FIG. 13. In addition, it is contemplated that the second rear mounting bracket 60 and the second front mounting bracket 80 may also be coextensive or integral, as shown in FIG. 13.

Each mounting bracket has an attachment plate 93 extending from an end (generally considered to be the top) of the mounting bracket in a perpendicular direction with respect to the mounting bracket. The attachment plate has at least one hole 99 to fixedly mount the attachment plate, and thus the mounting bracket, to a work surface such as a desk or table. Preferably, there are two holes 99 in each attachment plate for fixedly mounting the attachment plate 93 and its respective mounting bracket to the underside of a desk or table.

Figure 4:
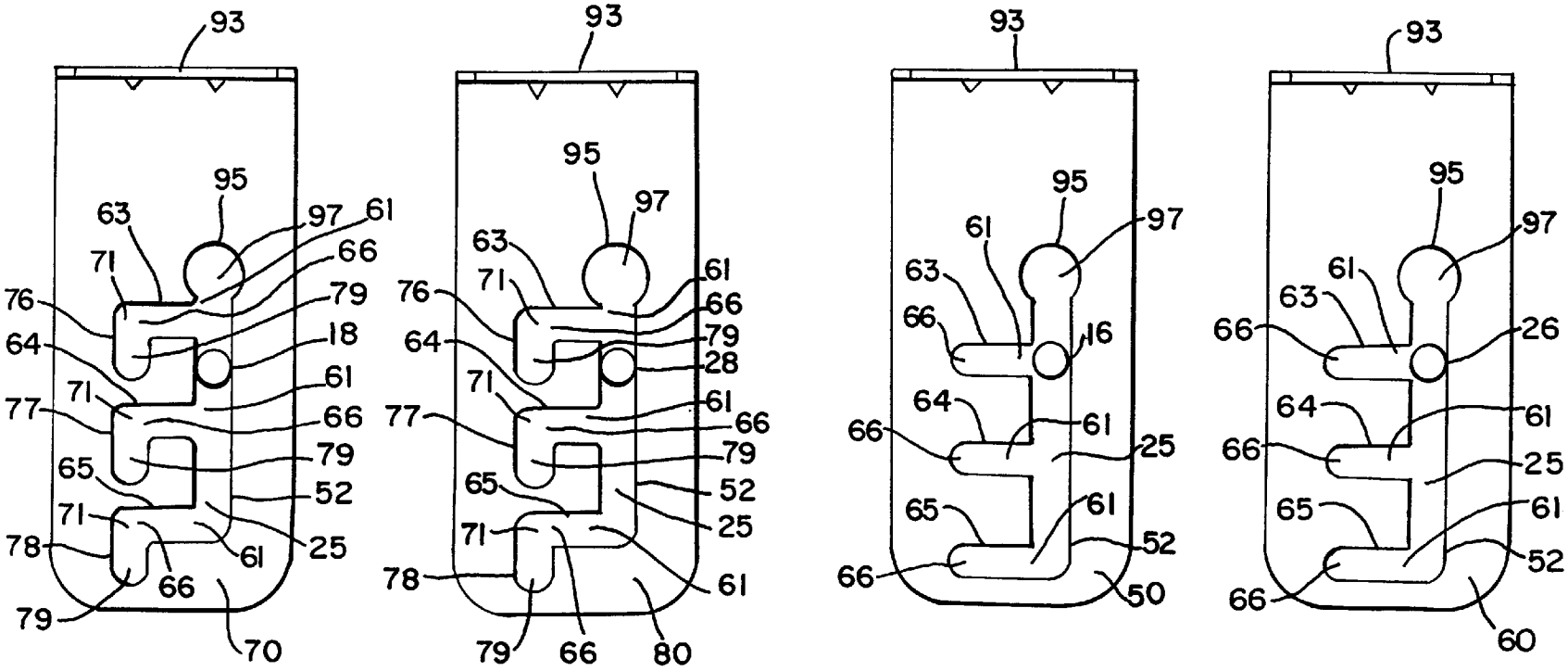
FIG. 4 is a side view of the mounting brackets of the apparatus of FIG. 1.

As shown in FIG. 4, each mounting bracket has a vertical slot 52 and a plurality of horizontal slots 63, 64, 65 to receive the retention posts 16, 18, 26, 28. Depending on the desired degree of adjustment, there may be any number of horizontal slots in each mounting bracket. Preferably, however, there are three horizontal slots in each mounting bracket, specifically a first horizontal slot 63, a second horizontal slot 64, and a third horizontal slot 65. The first horizontal slot is positioned above the third horizontal slot, and the second horizontal slot is positioned between the first and the third horizontal slots. Furthermore, in the most preferred embodiment of the present invention, each mounting bracket has an aperture 95 connected to the vertical slot. The aperture 95 has a diameter 97 that is sized to receive the head 17 on a retention post. Since the aperture is connected to the vertical slot, it allows the head to fit through the mounting bracket and the retention post to enter the vertical slot.

The vertical slot 52 of each mounting bracket runs in a vertical direction and is oriented in a perpendicular direction with respect to the mounting members and the object onto which the rear mounting brackets are mounted. Each vertical slot is connected to the horizontal slots in its respective mounting bracket and has a width 25 that is sized to receive the retention posts 16, 18, 26, 28. Accordingly, the vertical slots allow the retention posts to slide up and down, and in and out of the various horizontal slots.

The horizontal slots 63, 64, 65 of each mounting bracket run in a horizontal direction, and are oriented in a perpendicular direction with respect to the vertical slots and a parallel direction with respect to the mounting members. Each horizontal slot has an end 61 connected to its respective vertical slot, and an end 66 opposite its respective vertical slot. Each horizontal slot also has a width 25 that is sized to receive the retention posts 16, 18, 26, 28 in the same manner as the vertical slots. As a result, the horizontal slots allow the retention posts to slide forward and backward, and in and out of the vertical slots.

In the preferred embodiment of the present invention, the first and second front mounting brackets also have a plurality of locking slots 76, 77, 78 to receive the second and fourth retention posts 18, 28 and temporarily prevent them from moving in a forward or backward horizontal direction. The locking slots run in a vertical direction, and are oriented in a perpendicular direction with respect to the horizontal slots and a parallel direction with respect to the vertical slots. The number of locking slots depends on the number of horizontal slots, and there is one locking slot for every horizontal slot. Preferably, there are three locking slots for the three horizontal slots in each mounting bracket, specifically a first locking slot 76 corresponding to the first horizontal slot 63, a second locking slot 77 corresponding to the second horizontal slot 64, and a third locking slot 78 corresponding to the third horizontal slot 65. The first locking slot is positioned above the third locking slot, and the second locking slot is positioned between the first and the third locking slots. Each locking slot has an end 71 connected to the end 66 of its respective horizontal slot, and an end 79 that extends below the end 66 of its respective horizontal slot. Each locking slot also has a width 25 that is sized to receive the second and fourth retention posts 18, 28 in the same manner as the vertical and horizontal slots. As a result, the locking slots allow the second and fourth retention posts to slide up and down, and in and out of their respective horizontal slots. The locking slots, however, prevent the second and fourth retention posts, and thus the mounting members, from moving in a forward or backward horizontal direction when the second and fourth retention posts are positioned in the ends 79 of the locking slots.

As shown in FIGS. 1 and 4, the horizontal slots of the first rear mounting bracket are aligned with the ends 79 of the locking slots in the first front mounting bracket at the same level or vertical position. For instance, the first, the second, and the third horizontal slots 63, 64, 65 of the first rear mounting bracket 50 are aligned with the ends 79 of the first, the second, and the third locking slots 76, 77, 78 of the first front mounting bracket 70, respectively, at the same level. The horizontal slots 63, 64, 65 of the second rear mounting bracket 60 are also aligned with the ends 79 of the locking slots 76, 77, 78 of the second front mounting bracket 80, respectively, at the same level. In addition, the horizontal slots of the mounting brackets extend away from the vertical slot in the same direction as shown in FIG. 1.

The apparatus of the preferred embodiment of the present invention operates in the following manner. First, the keyboard tray is in a stored or closed position 3 underneath a desk or table. In this closed position 3, the tray members are slid back over the entire mounting members as shown in FIG. 2. Then, a user slides the keyboard tray outward away from the desk or table into an open position 4, and thus causes the tray members to slide along and away from the mounting members as also shown in FIG. 2. The mounting members do not move forward or backward when the keyboard tray is slid outward by the user since the second and fourth retention posts are positioned in the locking slots of the front mounting members. Eventually, the keyboard tray and the connected tray members are pulled outward far enough that the locking devices on the tray members lock the horizontal position of the tray members with respect to the mounting members. In this locked position, a movement of the keyboard tray causes the connected tray members, as well as the mounting members locked to the tray members, to move in the same manner as the keyboard.

Once the tray members are locked into position with respect to the mounting members, the angular and vertical position of the keyboard tray may be adjusted by moving the keyboard, and thus the mounting members and their retention posts, in the following manner. First, a user may pull up on the keyboard tray to move the tray members and mounting members in an upward direction. This action moves the second and fourth retention posts out of their respective locking slots and into a horizontal slot. The user may then slide the keyboard tray forward to move the attached tray members and mounting members in a forward direction. As a result, the retention posts are moved forward out of the horizontal slots and into their respective vertical slots.

Next, the user may then move the keyboard tray up or down to cause the retention posts to move up or down, respectively, in their vertical slots. The user may then move the retention posts to a higher or lower horizontal slot to adjust the vertical position of the mounting members, and thus the vertical position of the tray members and the keyboard tray. In addition, a user may also adjust the angular position of the keyboard tray by moving the second and fourth retention posts into a higher or lower horizontal slot than the first and third retention posts. After the user has positioned the keyboard to its desired vertical and angular position, the keyboard tray may be moved backward to cause the retention posts to slide to the end of their horizontal slots. Finally, the user may slide the keyboard tray downward to position the second and fourth retention posts into their respective locking slots. In this position, the mounting members, and thus the tray members and the keyboard tray, are prevented from moving in a forward or backward horizontal position until the adjustment process is repeated again from the beginning. Of course it is understood by one of skill in the art that the tray can be adjusted in any suitable manner keeping in mind that the above-described method is only illustrative.

FIGS. 5–12 show other embodiments of the apparatus of the present invention. In each of these embodiments, the apparatus is identical to the preferred embodiment described above with the exception of the slots in the mounting brackets and the manner of moving the retention posts in the slots of the mounting brackets to adjust the position of the keyboard tray. In order to eliminate redundancy and unnecessary repetition, only the slots in the mounting brackets and the manner of moving the retention posts in the slots of the mounting brackets to adjust the position of the keyboard tray will be described for the embodiments shown in FIGS. 5–12. The same reference numerals that were used to describe the preferred embodiment of the present invention will be used to refer to identical elements of the embodiments shown in FIGS. 5–12. Furthermore, only the first set of front and rear mounting brackets is depicted in detail in FIGS. 5–12, since the second set of front and rear mounting brackets is a mirror image of the first set.

Figure 5:
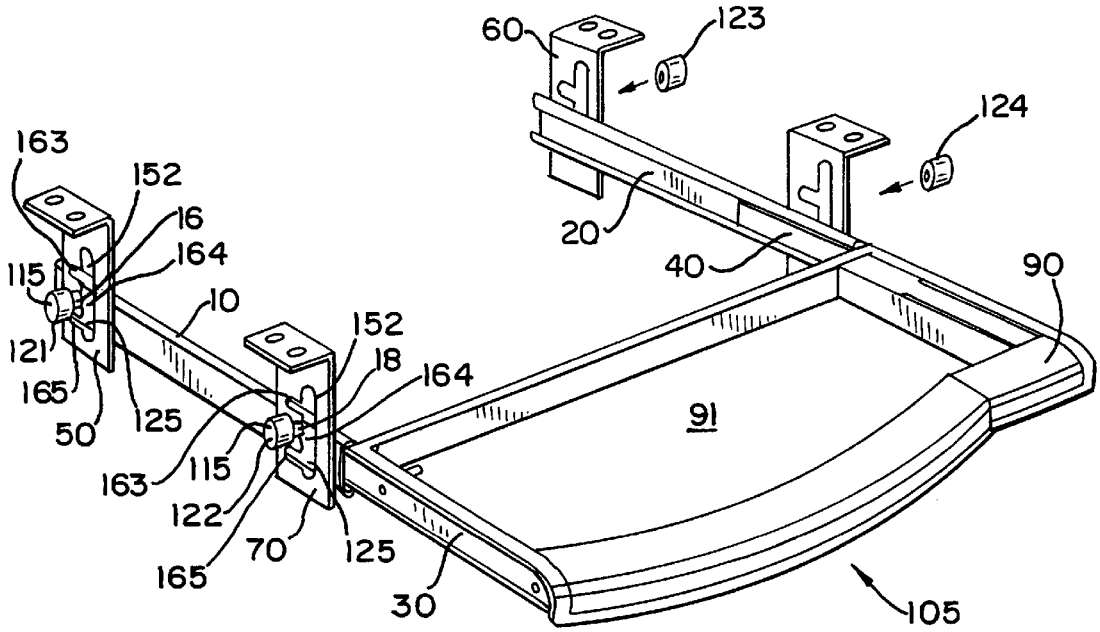
FIG. 5 is a perspective view of an alternative embodiment of the apparatus of the present invention.
Figure 6:
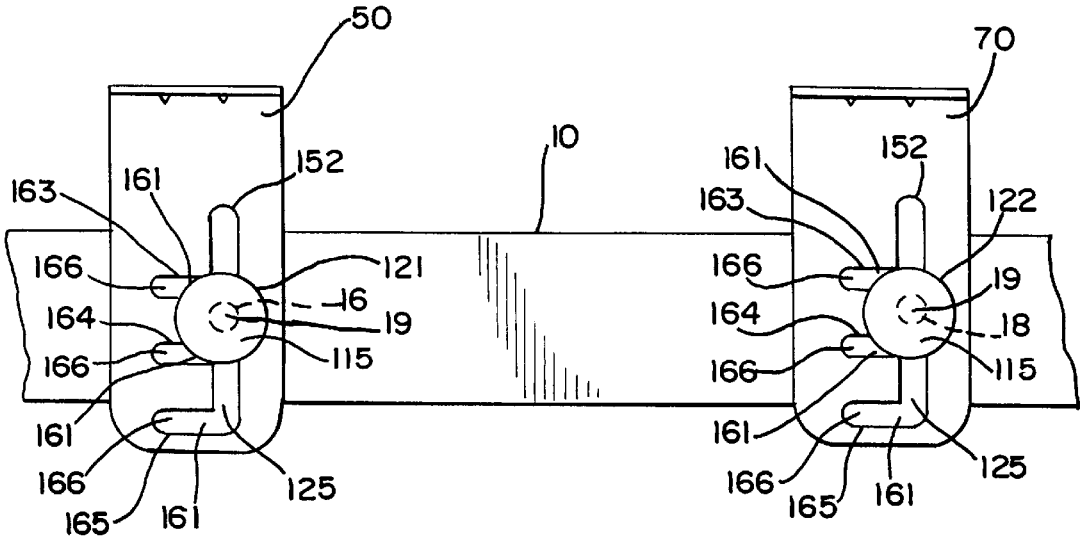
FIG. 6 is a side view of the mounting brackets of the apparatus of FIG. 5.

In the apparatus 105 of the embodiment shown in FIGS. 5–6, each mounting brackets has a vertical slot 152 and a plurality of horizontal slots 163, 164, 165 to receive the retention posts 16, 18, 26, 28. Depending on the desired degree of adjustment, there may be any number of horizontal slots in each mounting bracket. Preferably, however, there are three horizontal slots in each mounting bracket, specifically a first horizontal slot 163, a second horizontal slot 164, and a third horizontal slot 165. The first horizontal slot is positioned above the third horizontal slot, and the second horizontal slot is positioned between the first and the third horizontal slots.

The vertical slot 152 of each mounting bracket runs in a vertical direction, and is oriented in a perpendicular direction with respect to the mounting members and the object onto which the rear mounting brackets are mounted. Each vertical slot is connected to the horizontal slots in its respective mounting bracket and has a width 125 that is sized to receive the retention posts 16, 18, 26, 28. Accordingly, the vertical slots allow the retention posts to slide up and down, and in and out of the various horizontal slots.

The horizontal slots 163, 164, 165 of each mounting bracket run in a horizontal direction, and are oriented in a perpendicular direction with respect to the vertical slots and a parallel direction with respect to the mounting members. Each horizontal slot has an end 161 connected to its respective vertical slot, and an end 166 opposite its respective vertical slot. Each horizontal slot also has a width 125 that is sized to receive the retention posts 16, 18, 26, 28 in the same manner as the vertical slots. As a result, the horizontal slots allow the retention posts to slide forward and backward, and in and out of the vertical slots.

As shown in FIG. 6, the horizontal slots of the first rear mounting bracket are aligned with the horizontal slots of the first front mounting bracket at the same level or vertical position. For instance, the first, the second, and the third horizontal slots 163, 164, 165 of the first rear mounting bracket are aligned with the first, the second, and the third horizontal slots 163, 164, 165 of the first front mounting bracket, respectively, at the same level. The horizontal slots 163, 164, 165 of the second rear mounting bracket are also aligned with the horizontal slots 163, 164, 165 of the second front mounting bracket, respectively, at the same level. In addition, the horizontal slots of the mounting brackets extend away from the vertical slot in the same direction as shown in FIG. 5.

Also in this embodiment, end caps 121, 122, 123, 124 are threadably connected to the end of each retention post opposite the mounting members. Obviously, it is understood that a suitable thread is provided on the retention posts. In particular, a first end cap 121 is threadably connected to the end 19 of the first retention post 16 opposite the first mounting member, a second end cap 122 is threadably connected to the end 19 of the second retention post 18 opposite the first mounting member, a third end cap 123 is threadably connected to the end 19 of the third retention post 26 opposite the second mounting member, and a fourth end cap 124 is threadably connected to the end 19 of the fourth retention post 28 opposite the second mounting member. The end caps may be tightened down on each retention post and against their respective mounting bracket to restrict the movement of the retention post in its respective horizontal and vertical slots. Moreover, each end cap has an outer diameter 115 that is greater than the diameter of the retention posts and the width of the slots 125 in the mounting brackets. As a result, the end caps keep the retention posts from slipping out of the slots.

In the embodiment shown in FIGS. 5–6, the manner of moving the retention posts in the slots of the mounting brackets to adjust the position of the keyboard tray is as follows. Without the end caps being tightened down on the retention posts, a user slides the keyboard tray forward to move the attached tray members and mounting members in a forward direction. This action causes the retention posts to be moved forward out of the horizontal slots and into their respective vertical slots. The user may move the keyboard tray up or down to cause the retention posts to move up or down, respectively, in their vertical slots. The user may then move the retention posts to a higher or lower horizontal slot to adjust the vertical position of the mounting members, and thus the vertical position of the tray members and the keyboard tray. In addition, a user may also adjust the angular position of the keyboard tray by moving the second and fourth retention posts into a higher or lower horizontal slot than the first and third retention posts. After the user has positioned the keyboard to its desired vertical and angular position, the keyboard tray may be moved backward to cause the retention posts to slide to the end of their horizontal slots. Finally, the user may tighten down the end caps on the retention posts and against the mounting brackets. In this position, the mounting members, and thus the tray members and the keyboard tray, are prevented from moving in a forward or backward horizontal position until the end caps are loosened away from the retention posts and the mounting brackets.

Figure 7:
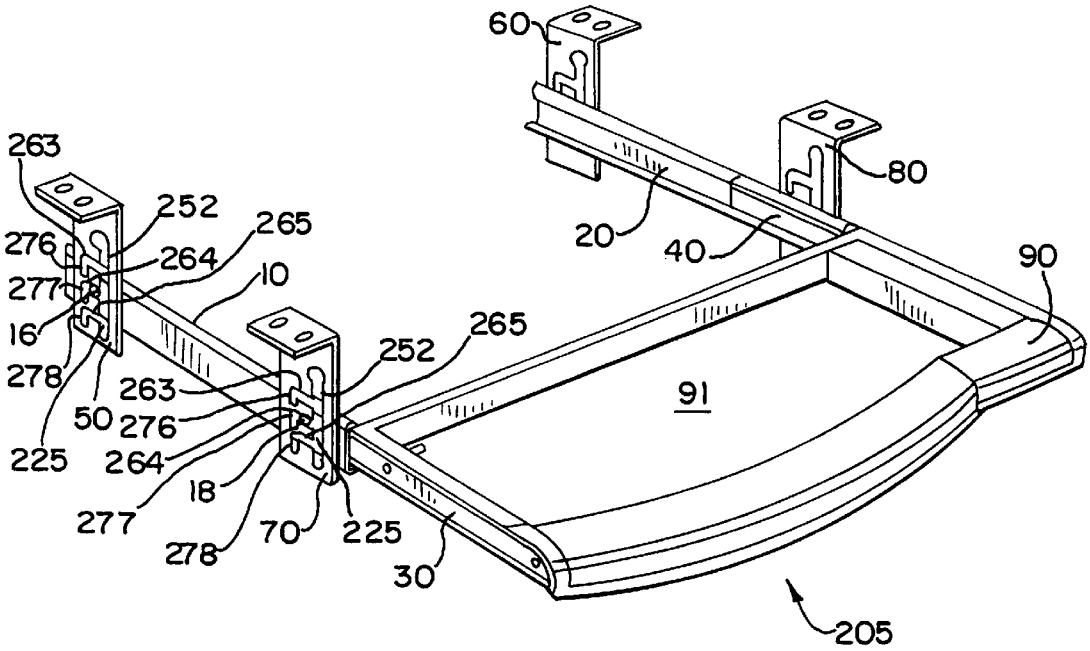
FIG. 7 is a perspective view of another embodiment of the apparatus of the present invention.
Figure 8:
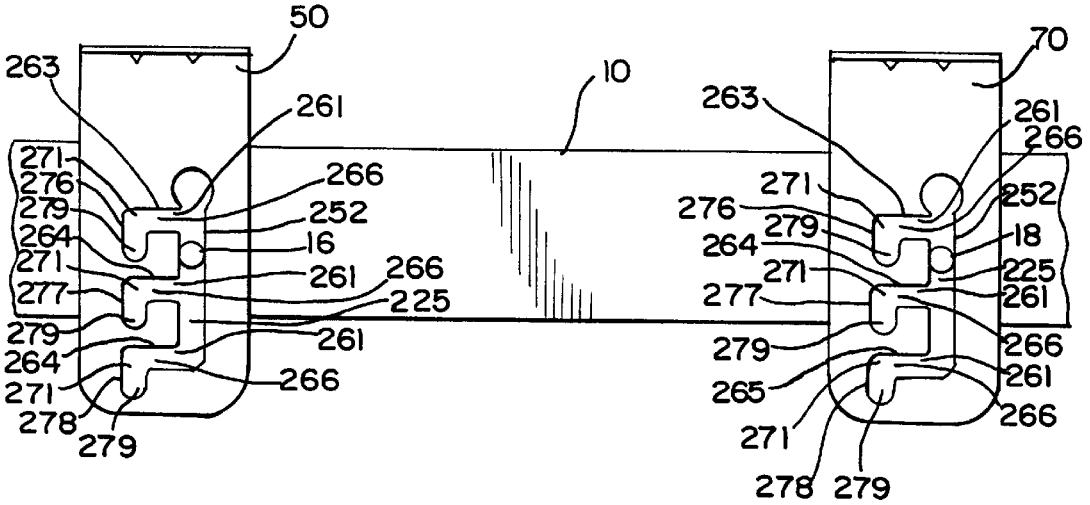
FIG. 8 is a side view of the mounting brackets of the apparatus of FIG. 7.

In the apparatus 205 of the embodiment shown in FIGS. 7–8, each mounting brackets has a vertical slot 252 and a plurality of horizontal slots 263, 264, 265 to receive the retention posts 16, 18, 26, 28. Depending on the desired degree of adjustment, there may be any number of horizontal slots in each mounting bracket. Preferably, however, there are three horizontal slots in each mounting bracket, specifically a first horizontal slot 263, a second horizontal slot 264, and a third horizontal slot 265. The first horizontal slot is positioned above the third horizontal slot, and the second horizontal slot is positioned between the first and the third horizontal slots.

The vertical slot 252 of each mounting bracket runs in a vertical direction, and is oriented in a perpendicular direction with respect to the mounting members and the object onto which the rear mounting brackets are mounted. Each vertical slot is connected to the horizontal slots in its respective mounting bracket and has a width 225 that is sized to receive the retention posts 16, 18, 26, 28. Accordingly, the vertical slots allow the retention posts to slide up and down, and in and out of the various horizontal slots.

The horizontal slots 263, 264, 265 of each mounting bracket run in a horizontal direction, and are oriented in a perpendicular direction with respect to the vertical slots and a parallel direction with respect to the mounting members. Each horizontal slot has an end 261 connected to its respective vertical slot, and an end 266 opposite its respective vertical slot. Each horizontal slot also has a width 25 that is sized to receive the retention posts 16, 18, 26, 28 in the same manner as the vertical slots. As a result, the horizontal slots allow the retention posts to slide forward and backward, and in and out of the vertical slots.

Also in the embodiment of the apparatus shown in FIGS. 7–8, the first and second front mounting brackets and the first and second rear mounting brackets have a plurality of locking slots 276, 277, 278 to receive the second and fourth retention posts 18, 28 and the first and third retention posts 16, 26, respectively, and temporarily prevent them from moving in a forward or backward horizontal direction. The locking slots run in a vertical direction, and are oriented in a perpendicular direction with respect to the horizontal slots and a parallel direction with respect to the vertical slots. The number of locking slots depends on the number of horizontal slots, and there is one locking slot for every horizontal slot. Preferably, there are three locking slots for the three horizontal slots in each mounting bracket, specifically a first locking slot 276 corresponding to the first horizontal slot 263, a second locking slot 277 corresponding to the second horizontal slot 264, and a third locking slot 278 corresponding to the third horizontal slot 265. The first locking slot is positioned above the third locking slot, and the second locking slot is positioned between the first and the third locking slots. Each locking slot has an end 271 connected to the end 266 of its respective horizontal slot, and an end 279 that extends below the end 266 of its respective horizontal slot. Each locking slot also has a width 225 that is sized to receive the retention posts 16, 18, 26, 28 in the same manner as the vertical and horizontal slots. As a result, the locking slots allow the retention posts to slide up and down, and in and out of their respective horizontal slots. The locking slots, however, prevent the retention posts, and thus the mounting members, from moving in a forward or backward horizontal direction when the retention posts are positioned in the ends 279 of the locking slots.

In this embodiment, the ends 279 of locking slots of the rear mounting brackets are aligned with the ends 279 of the locking slots of the front mounting brackets at the same level or vertical position. For instance, the ends of the first, the second, and the third locking slots 276, 277, 278 of the rear mounting brackets are aligned with the ends 79 of the first, the second, and the third locking slots 276, 277, 278 of the front mounting brackets, respectively, at the same level. The horizontal slots 263, 264, 265 of the rear mounting brackets are also aligned with the horizontal slots 263, 264, 265 of the front mounting brackets, respectively, at the same level. In addition, the horizontal slots of the mounting brackets extend away from the vertical slot in the same direction as shown in FIG. 7.

In the embodiment shown in FIGS. 7–8, the manner of moving the retention posts in the slots of the mounting brackets to adjust the position of the keyboard tray is as follows. First, a user may pull up on the keyboard tray to move the tray members and mounting members in an upward direction. This action moves the retention posts out of their respective locking slots and into a horizontal slot. The user may then slide the keyboard tray forward to move the attached tray members and mounting members in a forward direction. As a result, the retention posts are moved forward out of the horizontal slots and into their respective vertical slots. Next, the user may then move the keyboard tray up or down to cause the retention posts to move up or down, respectively, in their vertical slots. The user may then move the retention posts to a higher or lower horizontal slot to adjust the vertical position of the mounting members, and thus the vertical position of the tray members and the keyboard tray. In addition, a user may also adjust the angular position of the keyboard tray by moving the second and fourth retention posts into a higher or lower horizontal slot than the first and third retention posts. After the user has positioned the keyboard to its desired vertical and angular position, the keyboard tray may be moved backward to cause the retention posts to slide to the end of their horizontal slots. Finally, the user may slide the keyboard tray downward to position the retention posts into their respective locking slots. In this position, the mounting members, and thus the tray members and the keyboard tray, are prevented from moving in a forward or backward horizontal position until the adjustment process is repeated again from the beginning.

Figure 9:
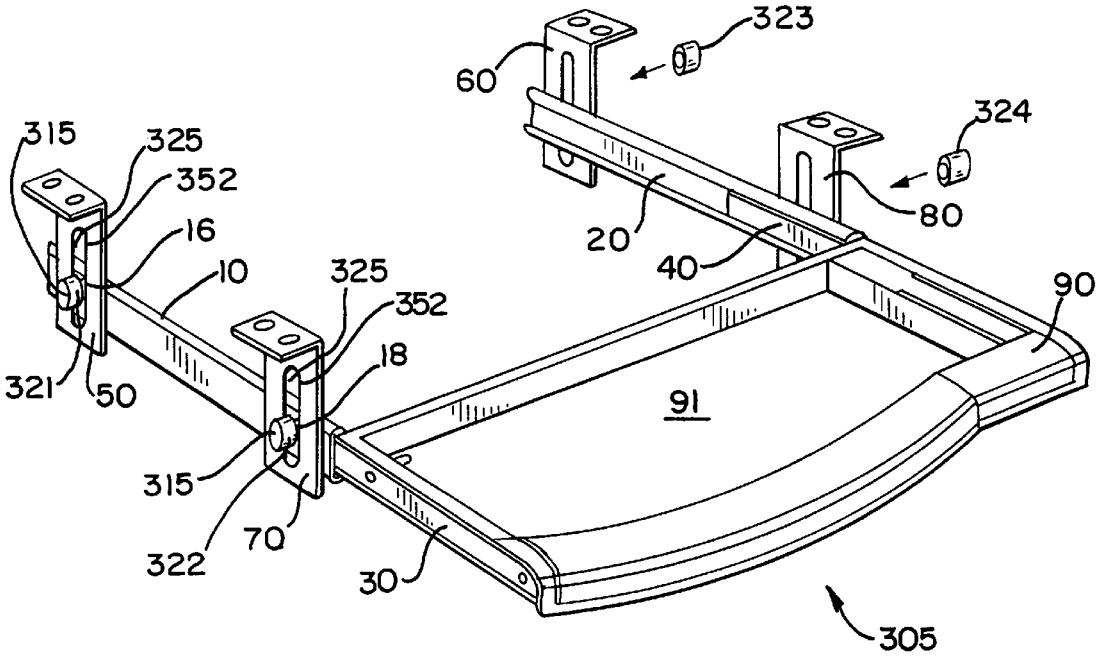
FIG. 9 is a perspective view of another embodiment of the apparatus of the present invention.
Figure 10:
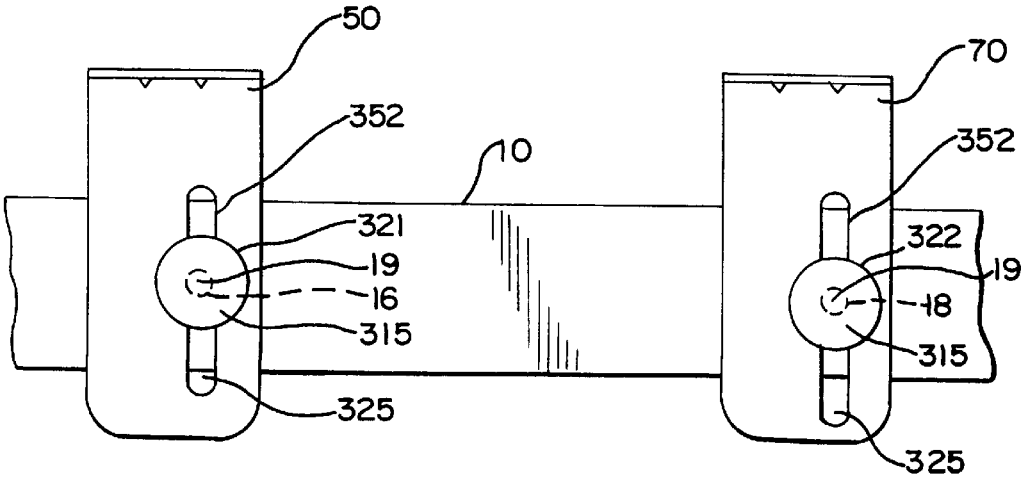
FIG. 10 is a side view of the mounting brackets of the apparatus of FIG. 9.

In the apparatus 305 of the embodiment shown in FIGS. 9–10, each mounting brackets has a vertical slot 352 that runs in a vertical direction, and is oriented in a perpendicular direction with respect to the mounting members and the object onto which the rear mounting brackets are mounted. Each vertical slot has a width 325 that is sized to receive the retention posts 16, 18, 26, 28. Accordingly, the vertical slots allow the retention posts to slide up and down.

Also in this embodiment, end caps 321, 322, 323, 324 are threadably connected to the end of each retention post opposite the mounting members. In particular, a first end cap 321 is threadably connected to the end 19 of the first retention post 16 opposite the first mounting member, a second end cap 322 is threadably connected to the end 19 of the second retention post 18 opposite the first mounting member, a third end cap 323 is threadably connected to the end 19 of the third retention post 26 opposite the second mounting member, and a fourth end cap 324 is threadably connected to the end 19 of the fourth retention post 28 opposite the second mounting member. The end caps may be tightened down on each retention post and against their respective mounting bracket to restrict the movement of the retention post in its respective vertical slots. Moreover, each end cap has an outer diameter 315 that is greater than the diameter of the retention posts and the width of the vertical slots 325 in the mounting brackets. As a result, the end caps keep the retention posts from slipping out of the vertical slots.

In the embodiment shown in FIGS. 9–10, the manner of moving the retention posts in the vertical slots of the mounting brackets to adjust the position of the keyboard tray is as follows. Without the end caps being tightened down on the retention posts, a user slides the keyboard tray up or down to cause the retention posts to move up or down, respectively, in their vertical slots. In addition, a user may also adjust the angular position of the keyboard tray by moving the second and fourth retention posts into a higher or lower vertical position than the first and third retention posts. After the user has positioned the keyboard to its desired vertical and angular position, the user may tighten down the end caps on the retention posts and against the mounting brackets. In this position, the mounting members, and thus the tray members and the keyboard tray, are prevented from moving in an up or down vertical position until the end caps are loosened away from the retention posts and the mounting brackets.

Figure 11:
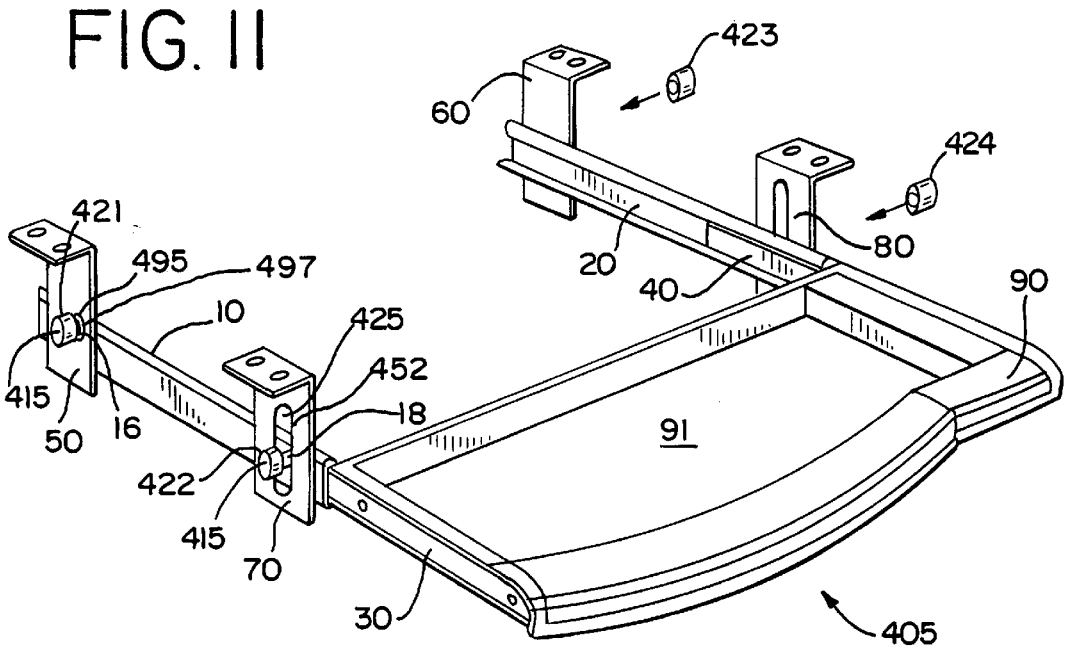
FIG. 11 is a perspective view of another embodiment of the apparatus of the present invention.
Figure 12:
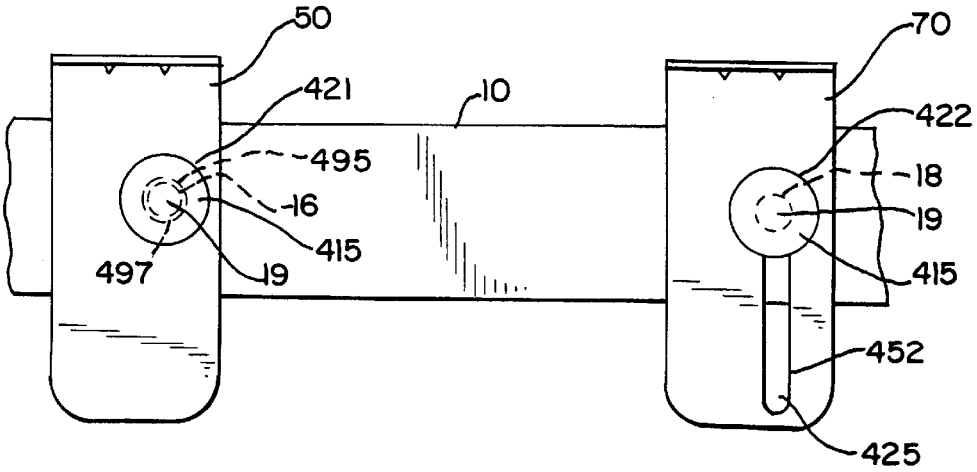
FIG. 12 is a side view of the mounting brackets of the apparatus of FIG. 11.

In the apparatus 405 of the embodiment shown in FIGS. 11–12, the first and second front mounting brackets are adjustably mounted to the second end of the first and second mounting members, respectively. The front mounting brackets each have a vertical slot 452 that runs in a vertical direction, and is oriented in a perpendicular direction with respect to the mounting members and the object onto which the rear mounting brackets are mounted. Each vertical slot has a width 425 that is sized to receive the second and fourth retention posts 18, 28. Accordingly, the vertical slots allow the second and fourth retention posts to slide up and down in the first and second front mounting brackets.

The first and second rear mounting brackets, however, are rotatably mounted to the first end of the first and second mounting members, respectively. The rear mounting brackets each have an aperture 495 with a diameter 497 that is sized to receive the first and third retention posts 16, 26. As a result, the first and third retention posts are free to rotate in the apertures of the rear mounting brackets, but they are not adjustable in a vertical or horizontal direction.

Also in this embodiment, end caps 421, 422, 423, 424 are threadably connected to the end of each retention post opposite the mounting members. In particular, a first end cap 421 is threadably connected to the end 19 of the first retention post 16 opposite the first mounting member, a second end cap 422 is threadably connected to the end 19 of the second retention post 18 opposite the first mounting member, a third end cap 423 is threadably connected to the end 19 of the third retention post 26 opposite the second mounting member, and a fourth end cap 424 is threadably connected to the end 19 of the fourth retention post 28 opposite the second mounting member. The end caps may be tightened down on the second and fourth retention posts and against their respective front mounting bracket to restrict the movement of the second and fourth retention posts in their respective vertical slots. Moreover, each end cap has an outer diameter 415 that is greater than the diameter of the retention posts, the width of the vertical slots 425 in the front mounting brackets, and the apertures 495 in the rear mounting brackets. As a result, the end caps keep the retention posts from slipping out of the vertical slots and the apertures.

In the embodiment shown in FIGS. 11–12, the manner of moving the retention posts in the vertical slots of the mounting brackets to adjust the position of the keyboard tray is as follows. Without the end caps being tightened down on the second and fourth retention posts, a user slides the keyboard tray up or down to cause the second and fourth retention posts to move up or down, respectively, in their vertical slots. As a result, a user is able to adjust the angular position of the keyboard tray by moving the second and fourth retention posts into a higher or lower vertical position than the first and third retention posts. After the user has positioned the keyboard to its desired angular position, the user may tighten down the end caps on the retention posts and against the mounting brackets. In this position, the mounting members, and thus the tray members and the keyboard tray, are prevented from moving in an up or down vertical position until the end caps are loosened away from the retention posts and the mounting brackets.

The keyboard supporting apparatus of the present invention can be applied with particular advantage to computer keyboard trays. Of course, it is readily apparent that the apparatus of the present invention can also be utilized with other kinds of keyboards or computer hardware. In addition, it is also readily apparent that the apparatus of the present invention may be utilized to support any object that can be stored in a tray underneath a desk or table.

The keyboard supporting apparatus of the present invention may be mounted to a work surface in a number of different ways. As previously mentioned, each mounting bracket has an attachment plate 93 with at least one hole 99 to fixedly mount the attachment plate, and thus the mounting bracket, to a work surface.

Alternatively, the attachment plates 93 of the mounting brackets may be removably attached to a work surface 501 with a simple mounting device 505, as shown in FIGS. 14–17. In the embodiment shown in FIGS. 14–17, the keyboard supporting apparatus is nearly identical to the preferred embodiment described above and shown in FIGS. 1–4, with the exception that the first rear mounting bracket 50 and the first front mounting bracket 70 are preferably coextensive or integral, and the second rear mounting bracket 60 and the second front mounting bracket 80 are also preferably coextensive or integral. In addition, each front mounting bracket in the keyboard supporting apparatus shown in FIGS. 14–17 has an additional vertical slot 540 to allow for work surfaces of varying thickness. It is to be understood, however, that any of the embodiments of the keyboard supporting apparatuses described above and shown in FIGS. 1–13 may be used with the simple mounting device 505. In order to eliminate redundancy and unnecessary repetition, the same reference numerals that were used to describe the preferred embodiment of the apparatus of the present invention will be used to refer to identical elements of the apparatus shown in FIGS. 14–17. Furthermore, only the second set of front and rear mounting brackets is depicted in detail in FIGS. 14–17, since the first set of front and rear mounting brackets is a mirror image of the second set.

The simple mounting device 505 comprises a first clamp 510 and a second clamp 520. The first clamp 510 is used to removably attach the first rear mounting bracket 50 and the first front mounting bracket 70 to the work surface 501, and the second clamp 520 is used to removably attach the second rear mounting bracket 60 and the second front mounting bracket 80 to the work surface 501. Similar to the first and second sets of mounting brackets, only the second clamp and its components are depicted in detail in FIGS. 14–17, since the first clamp and its components are a mirror image of the second clamp. Accordingly, only one set of reference numerals will be used to describe the components of each clamp.

Figure 16:
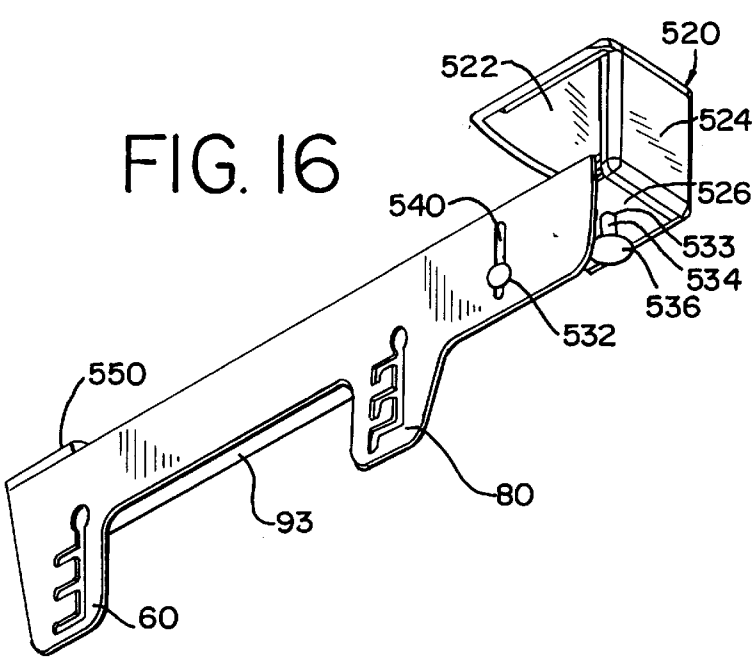
FIG. 16 is a bottom perspective view of one side of the mounting brackets of the apparatus and one clamp of the simple mounting device of FIG. 14.
Figure 15:
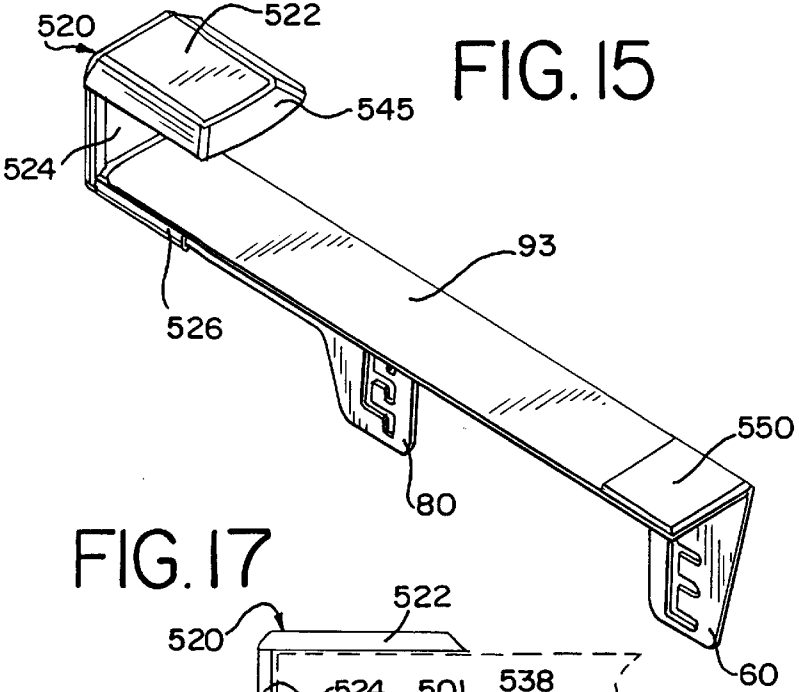
FIG. 15 is a top perspective view of one side of the mounting brackets of the apparatus and one clamp of the simple mounting device of FIG. 14.
Figure 17:
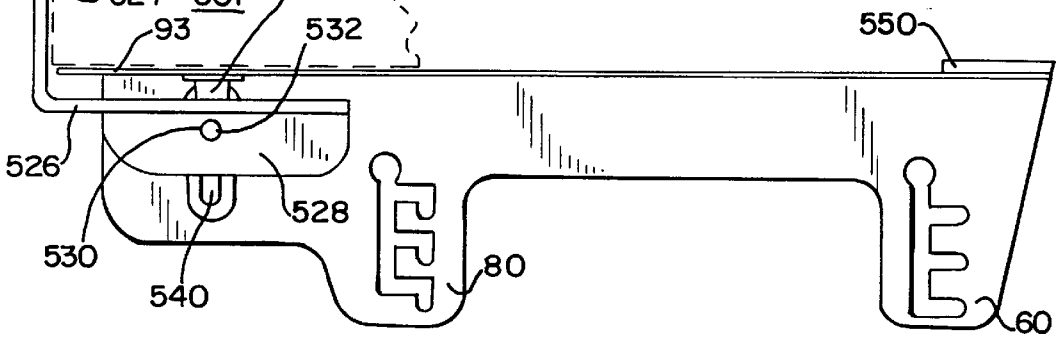
FIG. 17 is a side view of one side of the mounting brackets of the apparatus and one clamp of the simple mounting device of FIG. 14, with a partial side view of a work surface inside the clamp.

Each clamp has a first wall 522, a second wall 524, and a third wall 526. Preferably, the first, second, and third walls of each clamp are integral or coextensive with each other in such a manner that the clamp has an overall C-shaped appearance, as best shown in FIGS. 15–17. The first wall 522, the second wall 524, and the attachment plate 93 define a receptacle to receive an edge of the work surface 501.

The third wall 526 of each clamp has an extension plate 528 that extends perpendicularly from the third wall in a vertical direction, and runs parallel to the mounting brackets. The extension plate 528 has a hole 530 that is adapted to receive a rivet 532. Each rivet 532 slidably connects each clamp to the additional vertical slot 540 of its respective front mounting bracket. The third wall 526 also has a hole 533, preferably threaded, that is adapted to receive peg 534. Each peg 534 has a push head 538 at one end and a tightener 536 at the other end, as best shown in FIGS. 16–17.

A cover plate 545 may be placed between the first wall of each clamp and the top of the work surface to prevent damage to the work surface. The cover plate is preferably a separate component from the first wall of each clamp, but may be integral or coextensive with the first wall of each clamp. Also, a rubber pad 550 may be placed on top of the attachment plates 93 near the first and second rear mounting brackets, as shown in FIGS. 14–17, to prevent slippage between the attachment plates and the work surface.

The simple mounting device 505 removably attaches the keyboard supporting apparatus of the present invention to a work surface 501 in the following manner. Since the operation of the first and second clamps of the simple mounting device is the same, only the operation of the second clamp will be discussed. It is to be understood, however, that both the first and the second clamps are preferably fastened on to the edge of the work surface to provide greater stability for the simple mounting device.

First, an edge of the work surface is positioned in the receptacle defined by the attachment plate, first wall, and the second wall of the clamp. The additional slot 540 allows work surfaces of varying thickness to be positioned in this receptacle. Preferably, but not necessarily, the edge of the work surface is positioned flush with the second wall of the clamp. By then turning the tightener 536 in a clockwise direction, or depending upon the threading of hole 533, a counter-clockwise direction, peg 534 is rotated to force push head 538 into contact with the underside of attachment plate 93. Any gap between the attachment plate, the work surface, and the first wall of the clamp is then narrowed by the force of the push head. The tightener is turned until the push head forces a tight fit between the attachment plate, the work surface, and the first wall of the clamp. The clamp may be removed from the work surface by simply turning the tightener in the opposite direction and sliding the clamp away from the edge of the work surface. As a result, the clamps of the simple mounting device removably attach the keyboard supporting apparatus of the present invention to a worksurface.

The simple mounting device of the present invention can be applied with particular advantage to the keyboard supporting apparatus of the present invention. Of course, it is readily apparent that the simple mounting device of the present invention can also be utilized with other kinds of supports for keyboards. In addition, it is also readily apparent that the simple mounting device of the present invention may be utilized to removably attach a support for any object, not just a keyboard, that can be stored in a tray underneath a desk or table. Moreover, it is conceivable that the clamps of the simple mounting device may be modified without substantial loss of effectiveness by positioning the pegs in the first wall of the clamps instead of the third wall. Also, it is conceivable that the two clamps of the simple mounting device could be integral, coextensive, or connected to each other to form one overall clamp.

Those skilled in the art to which the invention pertains may make modifications and other embodiments employing the principles of this invention without departing from its spirit or essential characteristics, particularly upon considering the foregoing teachings. The described embodiments are to be considered in all respects only as illustrative and not restrictive and the scope of the invention is, therefore, indicated by the appended claims rather than by the foregoing description. Consequently, while the invention has been described with reference to particular embodiments, modifications of structure, sequence, materials and the like would be apparent to those skilled in the art, yet still fall within the scope of the invention.

What is claimed is:

1. In combination with a support apparatus having a first mounting bracket with a first attachment plate, a second mounting bracket with a second attachment plate, and a first work surface slidably connected to the first and second mounting brackets, a mounting device for removably attaching the support apparatus to a second work surface, the mounting device comprising:

a first clamp and a second clamp, each clamp having a first wall, a second wall, and a third wall; and wherein the first attachment plate is positioned between the first and third walls of the first clamp, and the second attachment plate is positioned between the first and third walls of the second clamp.

2. The mounting device of claim 1 wherein the second work surface is positioned between the first wall of the first clamp and the first attachment plate, and between the first wall of the second clamp and the second attachment plate.

3. The mounting device of claim 2 wherein the second work surface is also positioned flush against the second walls of the first and second clamps.

4. The mounting device of claim 2 wherein the first walls of the first and second clamps are substantially parallel to the second work surface.

5. The mounting device of claim 1 further comprising a first peg disposed in a hole in the third wall of the first clamp and a second peg disposed in a hole in the third wall of the second clamp, each peg having a push head at one end and a tightener at the other end.

6. The mounting device of claim 1 further comprising a first extension plate extending the third wall of the first clamp and a second extension plate extending from the third wall of the second clamp, each extension plate having a hole and a rivet disposed in the hole, wherein the first and second mounting brackets each have a slot to receive the rivets of the first and second extension plates, respectively.

7. The mounting device of claim 1 wherein the first clamp is slidably connected to the first mounting bracket and the second clamp is slidably connected to the second mounting bracket.

8. The mounting device of claim 1 wherein the first, second, and third walls of each clamp are integral with each other in such a manner that each clamp has an overall C-shaped appearance.

9. The mounting device of claim 1 wherein the first and second clamps are integral with each other to form one overall clamp.

10. The mounting device of claim 1 wherein the first attachment plate and the first and second walls of the first clamp define a first receptacle to receive the second work surface, and the second attachment plate and the first and second walls of the second clamp define a second receptacle to receive the second work surface.

11. A mounting device and support apparatus assembly comprising:

a support apparatus having a first mounting bracket with a first attachment plate, a second mounting bracket with a second attachment plate, and a first work surface slidably connected to the first and second mounting brackets;

a mounting device for removably attaching the support apparatus to a second work surface, the mounting device having a first clamp and a second clamp, each clamp having a first wall, a second wall, and a third wall; and wherein the first attachment plate and the first and second walls of the first clamp define a first receptacle to receive the second work surface, and the second attachment plate and the first and second walls of the second clamp define a second receptacle to receive the second work surface.

12. The mounting device of claim 11 wherein the second work surface is positioned between the first wall of the first clamp and the first attachment plate, and between the first wall of the second clamp and the second attachment plate.

13. The mounting device of claim 12 wherein the second work surface is also positioned flush against the second walls of the first and second clamps.

14. The mounting device of claim 12 wherein the first walls of the first and second clamps are substantially parallel to the second work surface.

15. The mounting device of claim 11 further comprising a first peg disposed in a hole in the third wall of the first clamp and a second peg disposed in a hole in the third wall of the second clamp, each peg having a push head at one end and a tightener at the other end.

16. The mounting device of claim 11 further comprising a first extension plate extending from the third wall of the first clamp and a second extension plate extending from the third wall of the second clamp, each extension plate having a hole and a rivet disposed in the hole, wherein the first and second mounting brackets each have a slot to receive the rivets of the first and second extension plates, respectively.

17. The mounting device of claim 11 wherein the first clamp is slidably connected to the first mounting bracket and the second clamp is slidably connected to the second mounting bracket.

18. The mounting device of claim 11 wherein the first, second, and third walls of each clamp are integral with each other in such a manner that each clamp has an overall C-shaped appearance.

19. The mounting device of claim 11 wherein the first and second clamps are integral with each other to form one overall clamp.

20. The mounting device of claim 11 further comprising a cover plate positioned between the first clamp and the second work surface.

* * * * *